US010456632B1

(12) United States Patent
Padgett

(10) Patent No.: US 10,456,632 B1
(45) Date of Patent: Oct. 29, 2019

(54) MOBILE SYSTEM FOR STORING, DISPENSING, POSITIONING, AND RETRIEVING GOLF BALLS FOR PUTTING AND CHIPPING PRACTICE

(71) Applicant: Russell S. Padgett, Okatie, SC (US)

(72) Inventor: Russell S. Padgett, Okatie, SC (US)

( * ) Notice: Subject to any disclaimer, the term of this patent is extended or adjusted under 35 U.S.C. 154(b) by 0 days.

(21) Appl. No.: 16/005,938

(22) Filed: Jun. 12, 2018

(51) Int. Cl.

| | |
|---|---|
| ***A63B 47/00*** | (2006.01) |
| ***A63B 69/36*** | (2006.01) |
| ***A63B 57/30*** | (2015.01) |
| *A63B 102/32* | (2015.01) |

(52) U.S. Cl.
CPC ..... *A63B 47/002* (2013.01); *A63B 57/357* (2015.10); *A63B 69/3676* (2013.01); *A63B 2102/32* (2015.10); *A63B 2210/52* (2013.01)

(58) Field of Classification Search
CPC ..... A63B 4/002; A63B 2225/09; A63B 47/02; A63B 57/00; A63B 69/3676
USPC ..... 221/151, 178, 208, 215; 473/405, 134, 473/137; 33/772; 294/19.2
See application file for complete search history.

(56) References Cited

U.S. PATENT DOCUMENTS

| | | | | |
|---|---|---|---|---|
| 909,289 | A | 1/1909 | Grisell | |
| 1,227,032 | A | 5/1917 | Beckett | |
| 1,778,952 | A | 10/1930 | McCullough | |
| 1,868,261 | A * | 7/1932 | Spencer | A63B 57/0006 221/301 |
| 1,875,174 | A | 8/1932 | McGivem | |
| 1,898,328 | A | 2/1933 | Wiley | |
| 1,937,180 | A | 11/1933 | Young | |
| 1,937,828 | A | 12/1933 | Macdonald | |
| 1,958,956 | A | 5/1934 | Preston | |
| 2,027,546 | A | 1/1936 | Macdonald | |
| 2,203,170 | A | 6/1940 | Macdonald | |
| 2,551,486 | A | 5/1951 | Burden | |
| 2,962,321 | A | 11/1960 | Fowler et al. | |
| 3,029,097 | A | 4/1962 | Ward | |
| 3,148,838 | A | 9/1964 | Cavanagh | |
| 3,149,872 | A | 9/1964 | Ward | |
| 3,206,067 | A | 9/1965 | Smith, Jr. et al. | |
| 3,258,091 | A | 6/1966 | Stevens | |
| 3,344,955 | A | 10/1967 | Ingham | |
| 3,810,669 | A | 5/1974 | Reid | |
| 3,876,201 | A | 4/1975 | King | |
| 3,901,545 | A | 8/1975 | Shott | |
| 4,058,336 | A | 11/1977 | Parkinson | |
| 4,073,529 | A | 2/1978 | Ostrin | |
| 4,141,558 | A | 2/1979 | Hoffman | |
| 4,363,311 | A * | 12/1982 | Rodney | A63B 69/408 124/16 |
| 4,575,092 | A | 3/1986 | Watson | |
| 4,610,373 | A | 9/1986 | Sherbondy | |
| 4,676,397 | A | 6/1987 | Hoffmeister | |
| 5,147,101 | A | 9/1992 | Tiller | |
| 5,265,926 | A | 11/1993 | DiNardo | |
| 5,292,161 | A | 3/1994 | Green | |

(Continued)

*Primary Examiner* — Jacob S. Scott
*Assistant Examiner* — Ayodeji T Ojofeitimi
(74) *Attorney, Agent, or Firm* — Thrive IP; Bernard Klosowski

(57) ABSTRACT

A system for dropping golf balls at pre-determined, repeatable patterns and distances from a hole or target for putting and chipping practice may include a removable ball holder and retrieval device to retrieve golf balls that have been struck for efficiently reloading the system for repeated golf ball dispensing.

20 Claims, 19 Drawing Sheets

(56) References Cited

U.S. PATENT DOCUMENTS

| | | | | |
|---|---|---|---|---|
| 5,433,491 | A | 7/1995 | Green | |
| 5,437,488 | A | 8/1995 | Richmond | |
| D371,179 | S | 6/1996 | Park | |
| 5,620,378 | A | 4/1997 | Fritz et al. | |
| 5,634,680 | A | 6/1997 | Green | |
| 5,975,600 | A | 11/1999 | Hwang | |
| 5,996,839 | A | 12/1999 | McLinn | |
| 6,059,334 | A | 5/2000 | Lacourse | |
| 6,182,983 | B1 | 2/2001 | Kim | |
| 6,199,926 | B1 | 3/2001 | Lemoine | |
| 6,386,607 | B1 | 5/2002 | Deininger | |
| 6,419,589 | B1 * | 7/2002 | Carter | A63B 57/0006 221/277 |
| 6,419,600 | B1 | 7/2002 | York et al. | |
| 6,572,167 | B2 | 6/2003 | Deininger | |
| 6,631,828 | B1 | 10/2003 | Reardon | |
| 6,739,477 | B1 | 5/2004 | Pascual | |
| 6,893,356 | B2 | 5/2005 | Thompson | |
| 7,086,561 | B2 | 8/2006 | Bosanac | |
| 7,479,076 | B2 | 1/2009 | Verga | |
| 7,506,781 | B2 | 3/2009 | Roberts | |
| 8,944,480 | B2 | 2/2015 | Nihra et al. | |
| 9,038,821 | B2 * | 5/2015 | Proulx | A63B 47/002 206/315.2 |
| 2002/0092862 | A1 | 7/2002 | Threadgill, Jr. | |
| 2002/0165037 | A1 * | 11/2002 | Stitz | A63B 69/0057 473/257 |
| 2004/0094565 | A1 | 5/2004 | Bosanac | |
| 2005/0070370 | A1 | 3/2005 | Whitaker | |
| 2005/0277482 | A1 | 12/2005 | Bennett | |
| 2006/0163273 | A1 | 7/2006 | Pommereau | |
| 2006/0230628 | A1 * | 10/2006 | Towne | G01B 3/12 33/772 |
| 2007/0111829 | A1 | 5/2007 | Verga | |
| 2008/0146367 | A1 | 6/2008 | Cruz | |
| 2008/0274838 | A1 * | 11/2008 | Roberts | A63B 47/002 473/405 |

* cited by examiner

MOBILE SYSTEM FOR STORING, DISPENSING, POSITIONING, AND RETRIEVING GOLF BALLS FOR PUTTING AND CHIPPING PRACTICE

BACKGROUND OF THE DISCLOSURE

In most sports, repetitive exercises and practice are essential for players to maintain and improve their skills. The game of golf is no exception. For example, a critical skill for a golfer is to have an accurate, repeatable putting stroke from anywhere on a putting surface. To achieve a repeatable putting stroke, the golfer may practice by manually placing golf balls in a desired pattern on a putting green or an artificial putting surface and putting the balls into holes on the green, and then the golfer repeats the process.

Manually placing the golf balls in the pattern and/or distances desired by the golfer is time consuming and imprecise. Moreover, after the golfer has putted a set of balls attempting to sink them into a designated hole, to achieve consistency the golfer must duplicate the previous ball positions to repeat the putting practice session. This set-up activity requires considerable effort and time to place the golf balls on the putting surface in repeatable positions for multiple practice putting.

In addition, not all putting practice greens have the hole locations in the practice set-up that the golfer desires. Most golf practice holes are preset by a golf course maintenance crew and for the practice green, these preset hole placements are limited and usually cover common putting scenarios rather than a combination of flat surfaces, hillsides, downhill or uphill slope, et cetera.

Moreover, many golfers constantly leave putts short of a golf hole and need to practice getting the putt to the hole at the correct speed to improve chances of making a putt on an intended line of the putt. This also holds true for those golfers who constantly hit the ball too hard and roll it past the hole.

As suggested above, effective practice requires repetitive golf shots; i.e. hitting golf ball after golf ball to hone a particular golf skill, such as chipping or putting. Of course, using one golf ball, hitting it, and retrieving it after each shot would be extraordinarily time consuming and impractical.

Using a bag to store and dispense golf balls is a more effective use of the golfer's practice time, but after numerous balls have been struck, they must be retrieved. So even if the golfer waits to retrieve multiple golf balls after a round of shots, it becomes more difficult and time consuming to retrieve several golf balls as a group. This usually involves picking up the individual balls by bending at the waist and loading the balls back into the ball storage bag. If a conventional ball snagger is used, the golfer must unload the snagger, which results in random patterns each time.

What is needed in the sport of golf is a system for dispensing multiple golf balls across various landscapes relative to a putting hole or practice target at repeatable distances and patterns. Moreover, the desired system should be equipped for rapid golf ball retrieval after putting or chipping the balls and for efficient reloading of the golf balls for repeated dispensing.

BRIEF SUMMARY

The present disclosure is directed in general to a golf ball dispensing system for putting and chipping practice. The system may include a detachable device for subsequent retrieval of golf balls for reinsertion into the system. In particular, the system dispenses golf balls at repeatable, predetermined distances and patterns from a cup, a hole or other temporary target.

According to one embodiment of the present disclosure, a golf ball positioning dispenser for putting practice may include an apparatus with a removable, hollow tube or similar device for holding golf balls. The dispenser may have a base unit with the tube extending through a body block, and a ball stop mechanism attached to the body block for dispensing the balls individually at fixed rate. The ball stop mechanism may have a ball release lever and a ball retention lever with the levers being pivotally attached to the body block through an axial pin attached to the body block for alternating cyclical control of the ball release lever and the ball retention lever into a corresponding hole of the dispenser to provide ball dispensing action as the unit is moved upon two support wheels. The wheels may be located on each side of the body block for circumferential travel around a practice hole. A timing wheel, which may be arcuate shaped, may be attached to one of the wheels to bias both the release lever and the retention lever disposed on the body block so that the levers are aligned above the body block. The timing wheel, attached to the radial surface of the support wheel, alternately enables both the ball release lever and the ball retention lever.

Also in this embodiment, an extendable and retractable tape measure may be provided to measure a hole position and maintain the wheels at a predetermined radial distance from the hole. Accordingly, a user can move the dispenser in a circumferential arc of travel determined by the tape measurer, wherein at least one cam of the timing wheel engages and alternatively disengages the biased levers to cause the ball dispensing action of the mechanism at predetermined arc intervals along the circumference of wheel travel to place the balls in position one-by-one along the circumference for practice putting.

The embodiment may further include a vertically oriented, golf ball loading, hollow tube or similar type device to facilitate loading the dispenser with golf balls.

The dispenser may apply a bias to each lever provided by a spring attached to the body block and extending to contact the lever, wherein the ball release lever and the ball retention lever are normally disposed through the ball release lever receiving hole in the tube in order to hold the balls in a ready position for dispensing. A ball numb may also be attached to an end of each biased lever wherein the timing wheel cam can engage the biased lever by contacting the numb.

In a further aspect, each timing wheel cam may be in concentric alignment with an outer circumference of the travel wheel. Each timing wheel may also include a plurality of cams displaced a predetermined angular distance from each other on the timing wheel. Still further in this embodiment, a freely rotatable attachment of the support wheels to the body block may include a cylindrical support wheel attachment boss extending from a lateral side of the apparatus body block, the cylindrical support wheel attachment boss forming an axle for the travel wheel.

In still other aspects of the disclosure, the device for holding golf balls may be disposed in an inclined position from the horizontal in order to provide a gravity feed of the balls through the tube in the direction of the mechanism positioned at the body block. Also, a longitudinal end of the apparatus golf ball holding tube may be closed; a ball exit hole being disposed proximate the longitudinal end of the apparatus golf ball holding tube; and the ball exit hole having an axial center line that is disposed approximately ninety degrees from a longitudinal axis of the removable hollow tube, or such similar device holding golf ball.

The embodiment may also include a smaller support wheel located, for instance, at a bottom rear of the apparatus, which can swivel and contact the ground to keep the dispenser apparatus in a stable position when stationary.

The measuring tape, in some aspects, may be extendable and retractable with premeasured and drilled holes or other markers for locking the apparatus at pre-defined distances from the practice hole so that a user can adjust and lock the dispensing apparatus to a desired radius of travel around the practice golf hole.

Some embodiments may also include a practice pin having an upper and lower section. As a one-piece unit, it is used to fit in current practice green holes. In another aspect, using the upper half of the aluminum practice pin, the pin may be inserted inside the pin top to allow for pin placement in any location on the practice green. This practice pin section is used to allow use when a different putting scenario is needed other than current practice green hole placements. Also, a practice hole can be used separately or in conjunction with the upper piece of the practice pin. Still further, a temporary hole cover can be used to hold the temporary pin in place while the apparatus is circled around the practice hole. To add another practice challenge, a detachable speed ramp unit is supplied to aid users control striking power and golf ball roll distance when putting the golf ball towards the practice golf hole.

In another embodiment, a method for releasing golf balls uses a locking and release device by itself wherein a latching lever is moved in an outward direction from a ball storage tube. This action moves a ball block out of the way and allows the golf balls to drop freely to the ground and out of the storage tube. Similarly, the ball block can be moved out of the way manually to permit the golf balls to be released from the storage tube. Balls can also be picked up by the tube by pressing the ball block against each ball and receiving the ball into the tube.

Another method for releasing ball from the storage tube is accomplished by squeezing a bottom handle grip, which cause a grip release rod to be pulled toward a grip top. This compresses grip springs along guide bolts, which are used to hold the grip bottom, the grip top, and the grip compression springs in place. This also pulls the grip release rod in a direction that causes the golf ball locking/release lever to be moved and pivot around a pivot pin proximate a bottom of the tube. This in turn causes the ball block to move out of the way allowing the golf balls to drop freely to the ground from the storage tube.

Additional objects and advantages of the present subject matter are set forth in, or will be apparent to, those of ordinary skill in the art from the description herein. Also, it should be further appreciated that modifications and variations to the specifically illustrated, referenced, and discussed features, processes, and elements hereof may be practiced in various embodiments and uses of the disclosure without departing from the spirit and scope of the subject matter. Variations may include, but are not limited to, substitution of equivalent means, features, or steps for those illustrated, referenced, or discussed, and the functional, operational, or positional reversal of various parts, features, steps, or the like. Those of ordinary skill in the art will better appreciate the features and aspects of the various embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE DISCLOSURE

Figure 1:
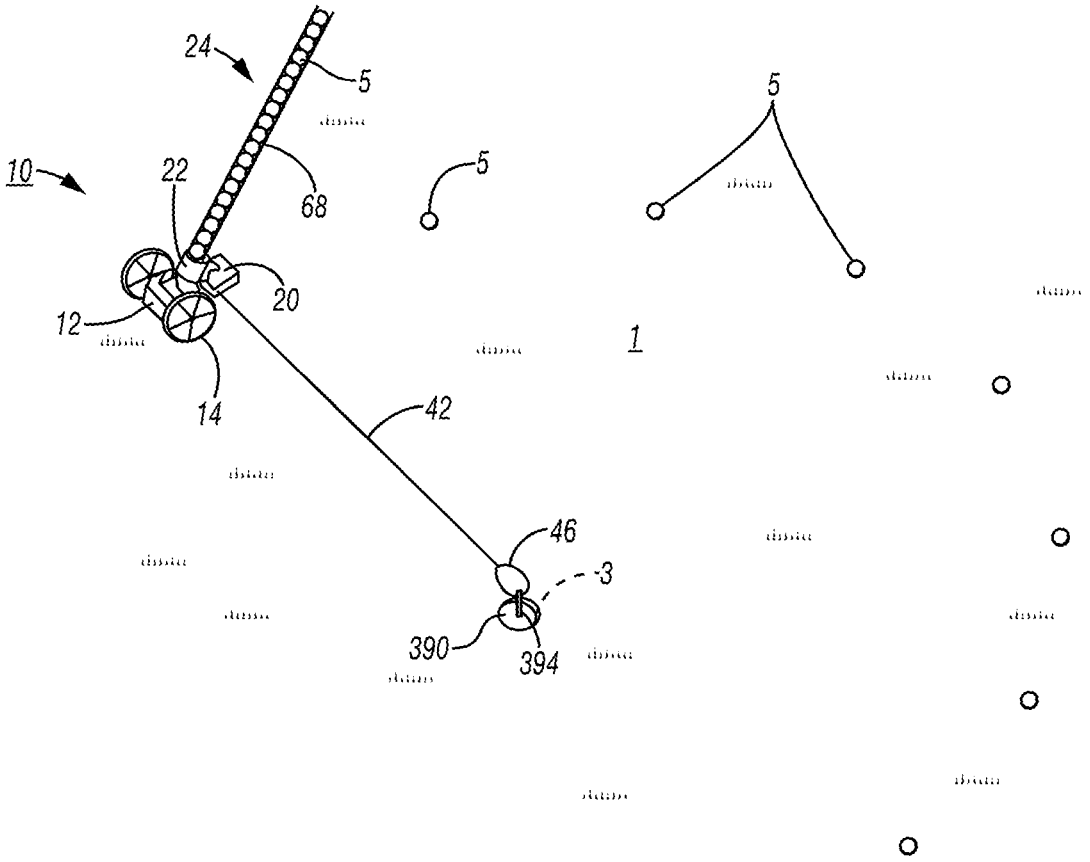
FIG. 1 is a perspective view of a golf ball dispensing and practice system in an intended use environment according to an aspect of the disclosure.

Detailed reference will now be made to the drawings in which examples embodying the present subject matter are shown. The detailed description uses numerical and letter designations to refer to features of the drawings.

The drawings and detailed description provide a full and written description of the present subject matter, and of the manner and process of making and using various exemplary embodiments, so as to enable one skilled in the pertinent art to make and use them, as well as the best mode of carrying out the exemplary embodiments. However, the examples set forth in the drawings and detailed descriptions are provided by way of explanation only and are not meant as limitations of the disclosure. The present subject matter thus includes any modifications and variations of the following examples as come within the scope of the appended claims and their equivalents.

Although detailed embodiments are disclosed as required, it is to be understood that the embodiments are merely exemplary. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the various embodiments of the present disclosure.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Wherever the phrase "for example," "such as," "including" and the like are used herein, the phrase "and without limitation" is understood to follow unless explicitly stated otherwise. Similarly, "an example," "exemplary" and the like are understood to be non-limiting.

The term "substantially" allows for deviations from the descriptor that do not negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etcetera. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; i.e., in the sense of "including, but not limited to".

Any discussion of prior art in the specification should in no way be considered as an admission that such prior art is widely known or forms part of common general knowledge in the field.

The various embodiments of the disclosure and/or equivalents falling within the scope of present disclosure overcome or ameliorate at least one of the disadvantages of the prior art, or provide a useful alternative.

Turning now to the figures, FIG. 1 shows a mobile practice system designated in general by reference numeral 10 for storing, dispensing, positioning, and retrieving golf balls for putting and chipping practice. As shown in this example, the system 10 may broadly include a base or chassis 12, one or more wheels 14, a tape measure unit or apparatus 20, a golf ball delivery mechanism 22, and a ball storage and retrieval device 24. The device 24 may include a holder 68 made, for instance, from Plexiglas®-type or other durable and/or see-through material to indicate to a user a remaining number of golf balls 5 in the tube 68. Although the holder 68 may be a clear tube or cylinder as shown, the disclosure is not limited to the exemplary transparent cylinder and may be, for instance, square or rectangular in shape with clear windows.

With continued reference to FIG. 1 the system 10 can dispense golf balls 5 on a putting green 1 around a cup or hole 3 in a circular or circumferential pattern at repeatable distances from the cup 3 and between each ball 5. Here, a tape 42 is extended from the tape measure unit 20 with a terminal end tape clip 46 attached to a temporary pin 394, which is inserted in a hole cover 390. As explained in greater detail below, as the base wheels 14 roll the unit 10 around the hole 3 at the desired distance set by the tape 42, the system 10 dispenses or drops the golf balls 5 at a controlled rate, which in turn affects the distance between the balls 5. Accordingly, a golfer can repeat the same pattern, and therefore, practice the same shots targeting the pin 394 in order to improve muscle memory to achieve an accurate, repeatable putting stroke.

Figure 2:
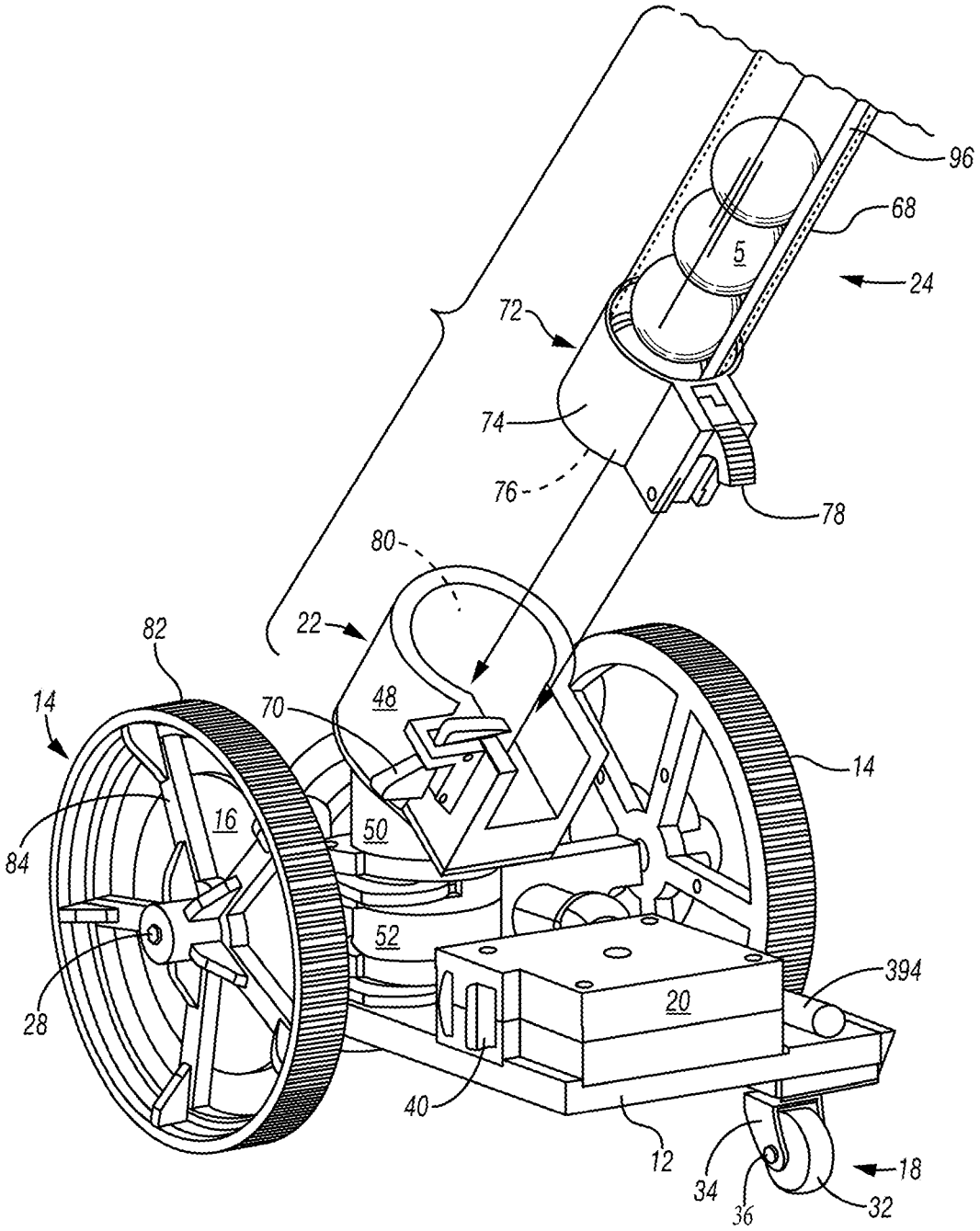
FIG. 2 is a partial perspective, detailed view of some components of the system as in FIG. 1.
Figure 3:
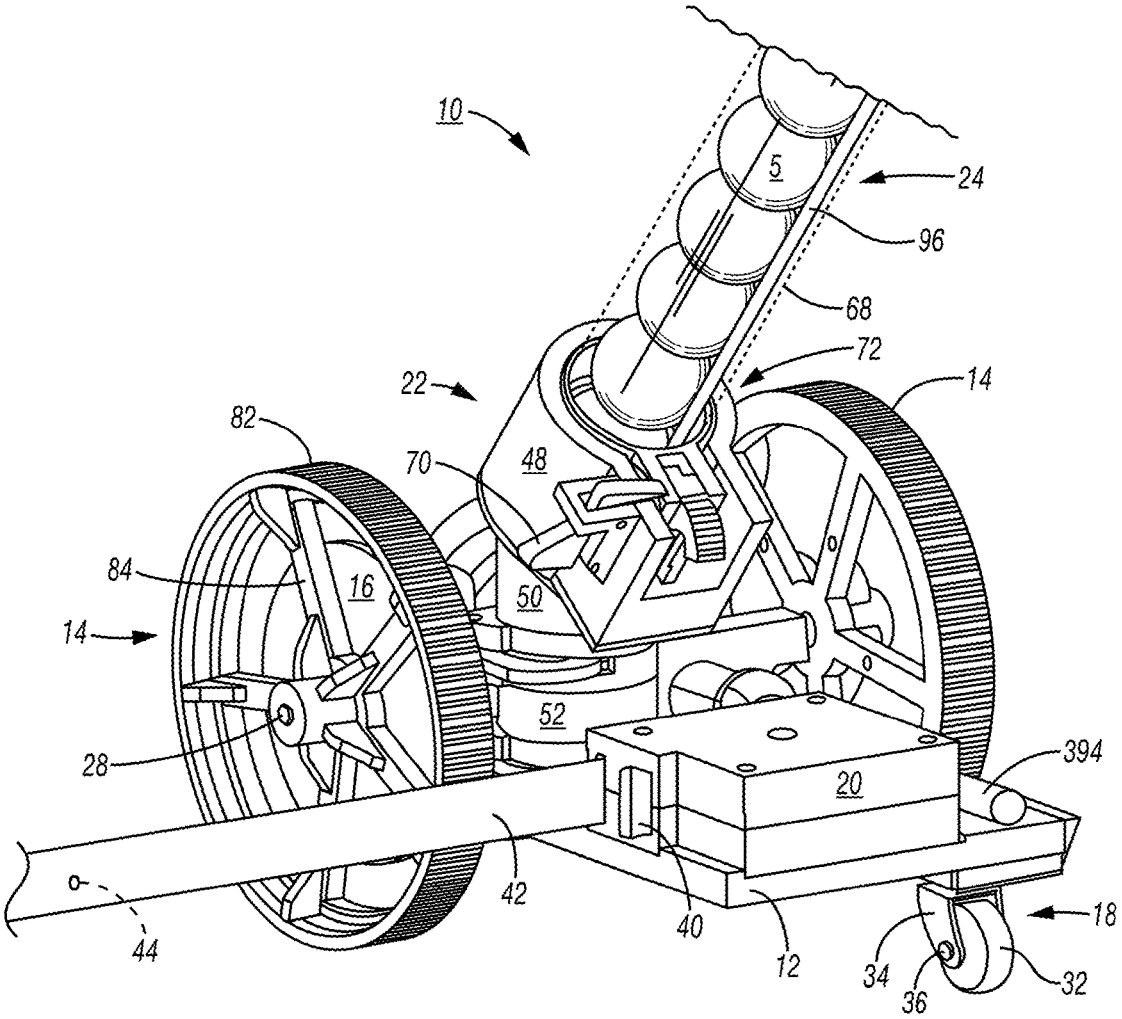
FIG. 3 is a perspective view of the system as in FIG. 2, particularly showing insertion or removal of a component.

FIGS. 2 and 3 more clearly show the system 10 broadly introduced in FIG. 1. FIG. 2 particularly shows the device 24 being mated with the golf ball delivery mechanism 22. More specifically, the delivery mechanism 22 is carried by the base 12 to which the wheels 14 are rotatably connected. In this example, a timing wheel 16 is attached to and rotates with one of the wheels 14 thereby determining the drop rate and spacing of the golf balls 5. As shown, the wheels 14 may have tread 82 for superior traction and spokes 84 for reduced weight and support. For further stability and steering ease, a mini-wheel or steering wheel assembly 18 can be attached to the base 12. The mini-wheel assembly 18 may include a wheel 32 rotatably attached to a wheel bracket 34 via an axle 36. A bearing 38 (see FIG. 6) is provided to enable the mini-wheel assembly 18 to swivel.

Also in the embodiment shown in FIGS. 2 and 3, the tape 42 of the tape measure unit 20 is held in place via the tape stop 40. Although the arrangement of the components on the base 12 can be modified as needed, the tape measure unit 20 is situated in back of the wheels 14 and the mechanism 22 since the system 10 works by pushing it forward, which, as explained below, causes its wheels 14 to move in a counter clockwise direction.

As introduced above, the golf ball delivery mechanism 22 to which the device 24 is mated may include a base unit 48, which has a receptacle or keyhole 80 for receiving a tube retaining assembly 72 of the device 24. More specifically, the tube retaining assembly 72 shown in FIG. 2 may include a pipe end or sleeve 74 having a ball opening or aperture 76. A ball latch 78 may be provided to control a flow of balls 5 from the tube 68, which is detailed below. Also, the sleeve 74 can be snap-fitted or slid into the complementary shaped keyhole 80 to mate the golf ball delivery mechanism 22 to the device 24. By way of example, the golf ball delivery mechanism 22 may have a latch or catch 70 that snaps over a portion of the sleeve 74 to retain it in the keyhole 80. Still further, the golf ball delivery mechanism 22 may include an upper chamber 50 and a lower chamber 52 for controlled delivery of the balls 5. For instance, the device 24 may include a grip release rod 96 to allow a user to control release of the golf balls 5 through the golf ball delivery mechanism 22. Stated another way, without the control provided by the grip release rod 96, the balls 5 would release continuously when the system 10 is moving. The grip release rod 96 allows golf balls 5 to flow only when the user wants the golf balls 5 to flow into golf ball delivery mechanism 22.

FIG. 3 most clearly shows the device 24 mated with the golf ball delivery mechanism 22. Here, the latch 70 is snapped over a portion of the sleeve 74 to retain it in the keyhole 80. Still further, FIG. 3 shows the tape 42 extended from the tape measure unit 20. Several distance markers or premeasured holes 44 are marked on or through the tape 42 to set desired distances from a chipping or putting target. Although the practice pin 394 is shown still attached to the base 12, in practice it would be likely be installed in a pin 3 as shown in FIG. 1.

Figure 4:
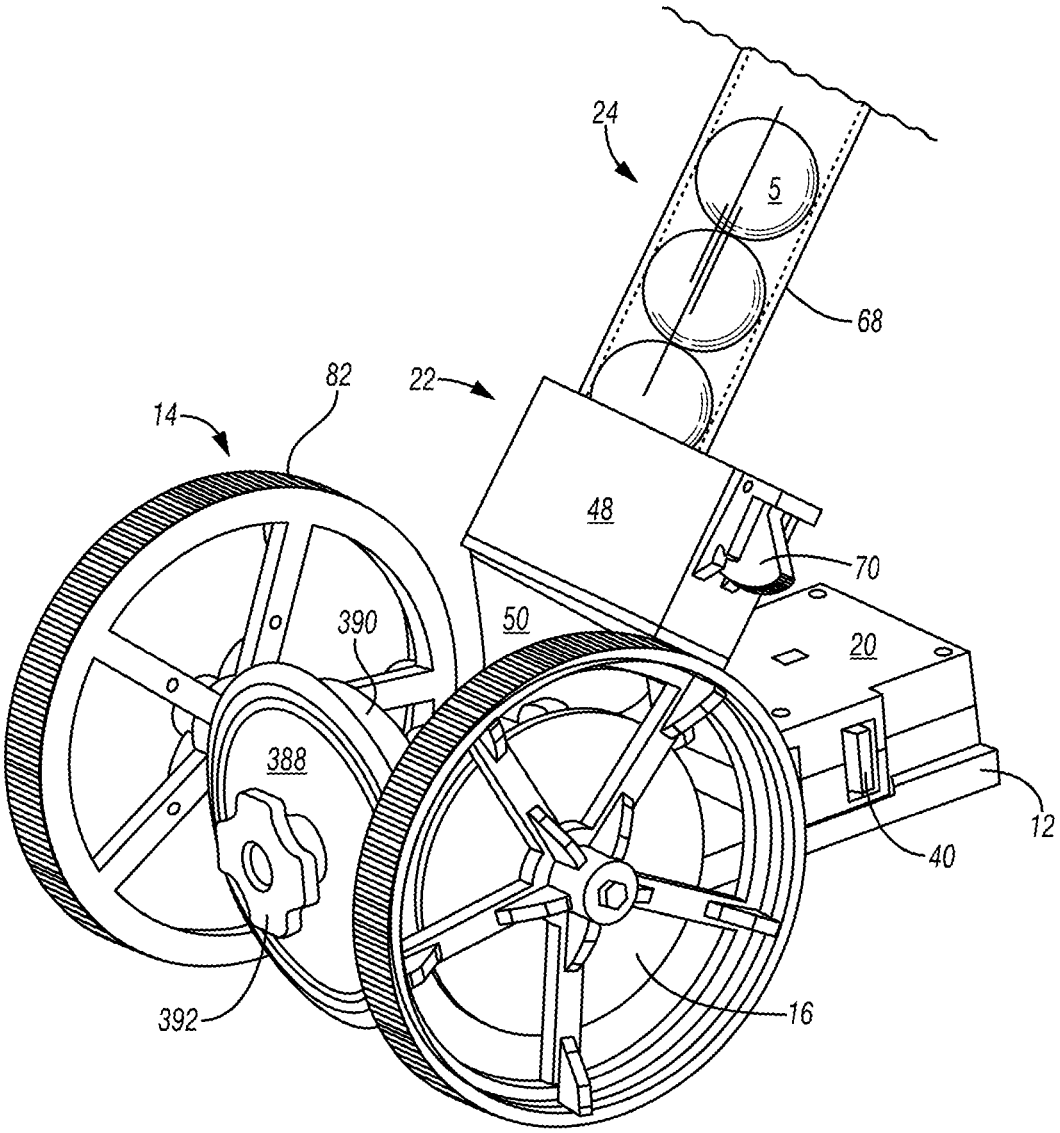
FIG. 4 is a partial perspective view of the system as in FIG. 3, particularly showing the component in a connected state.

FIG. 4 is another view of the device 24 mated with the golf ball delivery mechanism 22. FIG. 4 particularly shows exemplary chipping or putting targets such as a temporary hole 388 and a temporary hole cover 390, which can both be used with the detachable pin 394 as in FIG. 1. Here, the hole 388 and the cover 390 are connected to the device 24, more particularly to the base 12, using a base nut or knob 392, which screws or snaps through the hole 388 and the cover 390 to secure them in place when not in use.

Figure 5:
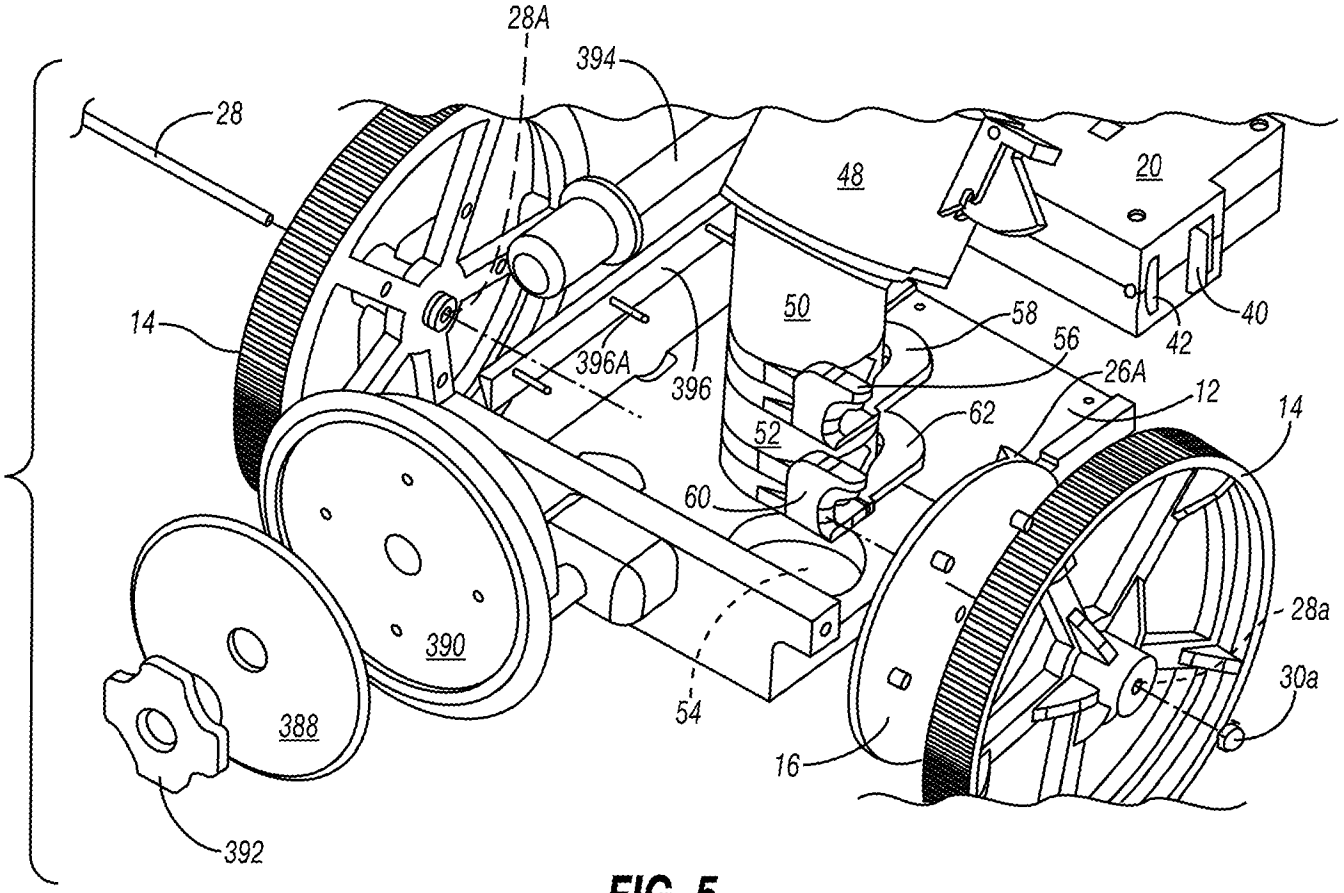
FIG. 5 is a partial perspective, exploded view of the system similar to FIG. 4.

Turning to FIG. 5, the hole 388 and the cover 390 are disconnected from the system 10. Also shown is an axle 28 that extends through wheel holes 28A of the wheels 14, and which is secured with end caps or locking nuts 30A, to create a cylindrical joint. This exploded view also best shows the base unit 48 with the upper chamber 50 and the lower chamber 52 for controlled ball delivery. More specifically, a golf ball stop lever 56 with a golf ball stop numb 58 and a golf ball release lever 60 with a golf ball release numb 62 are movably connected between the upper chamber 50 and the lower chamber 52. The stop lever 56 and the golf ball release lever 60 will interact with timing cams such as cam 26A on the timing wheel 16 as the wheel 14 turns. Further explanation of this interaction is explained by way of exemplary operation with respect to FIGS. 7, 8 and 9 below. Briefly, however, with reference to FIGS. 4 and 5 golf balls 5 will be dispensed through a base aperture 54 in the following sequence: the tube 68 containing golf balls 5 is loaded into the golf ball delivery mechanism 22 and latched in place by the tube retention lever 70. Golf balls 5 then flow via gravity to the golf ball stop numb 58 attached at the end of golf ball stop lever 56 when the release rod 196 (see FIG. 4) is engaged by the user squeezing grip handles (compare grips 190, 192 in FIG. 11B). The turning of the timing wheel 16 brings the timing wheel cam 26A into contact with the golf ball stop lever 56. Further forward movement of the system 10 moves the wheels 14 and therefore the timing wheel 16 counter clockwise pushing the golf ball stop lever 56 back and moving the golf ball stop numb 58 away from the golf ball 5 in the tube 68 allowing gravity to drop the golf ball 5 to the golf ball release lever 60 and golf ball release numb 62, which prevents the golf ball 5 from dropping further.

As the system 10 continues to move in a counter clockwise direction around the practice hole 3, the timing wheel 16 rotates the timing wheel cam 26B, which engages the release lever 60 which in turn permits the release lever numb 62 to move out of the way and allow the single golf ball 5 to drop through the base unit hole 54 to the putting green 1 as in FIG. 1. Thus, the cam 26A is used in conjunction with the lever 56, and the cam 26B is used in conjunction with the lever 60 in alternating operation.

Figure 6:
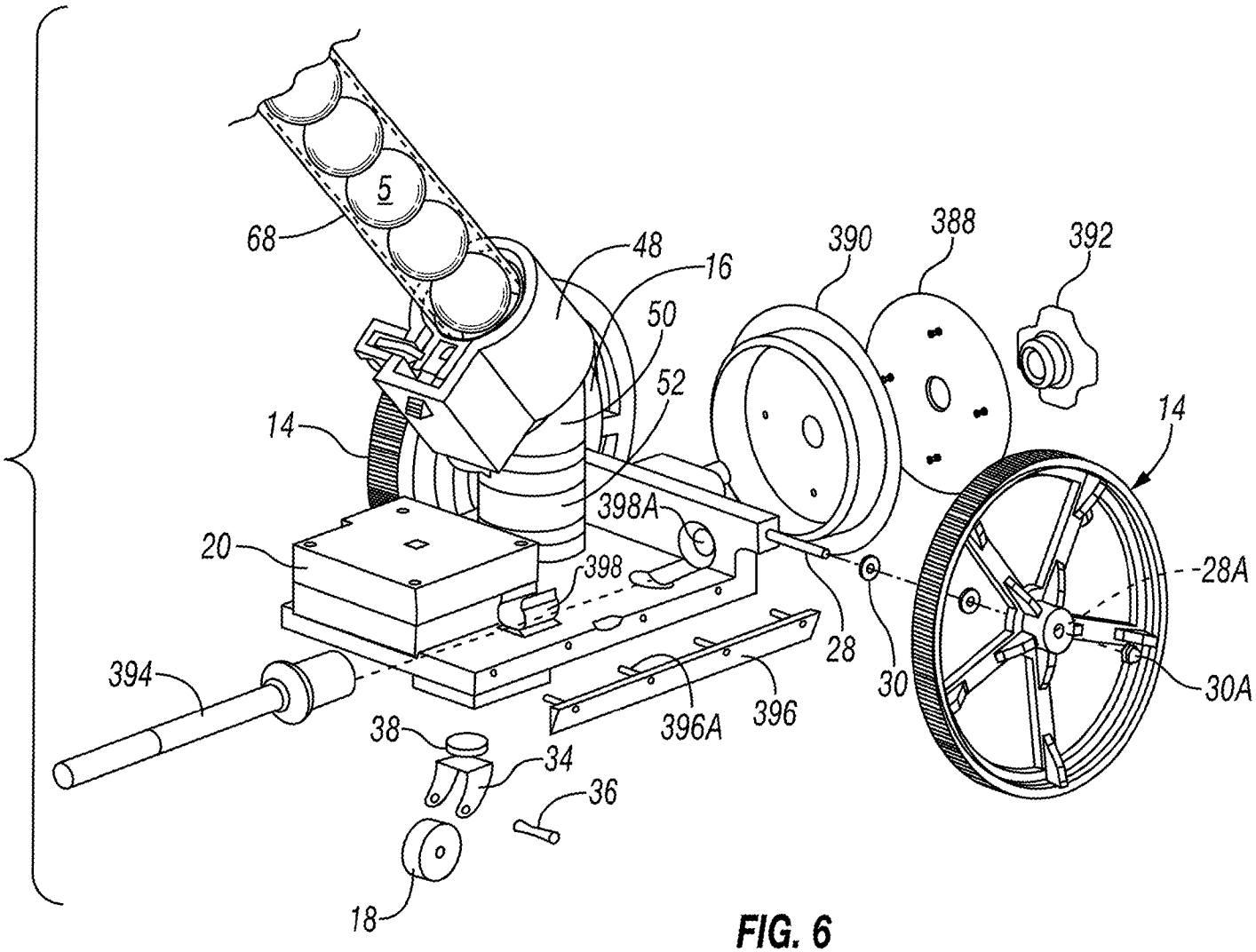
FIG. 6 is another partial perspective, exploded view of the system similar to FIG. 5.

FIGS. 5 and 6 also introduce another practice component of the system 10: a speed ramp 396 with stakes 396A. The speed ramp 396 and its multiple uses are described in further detail with respect to FIG. 18. FIG. 6 also more particularly shows a holder 398 and a storage compartment 398A for receiving the pin 394 for storage during non-use.

Figure 7:
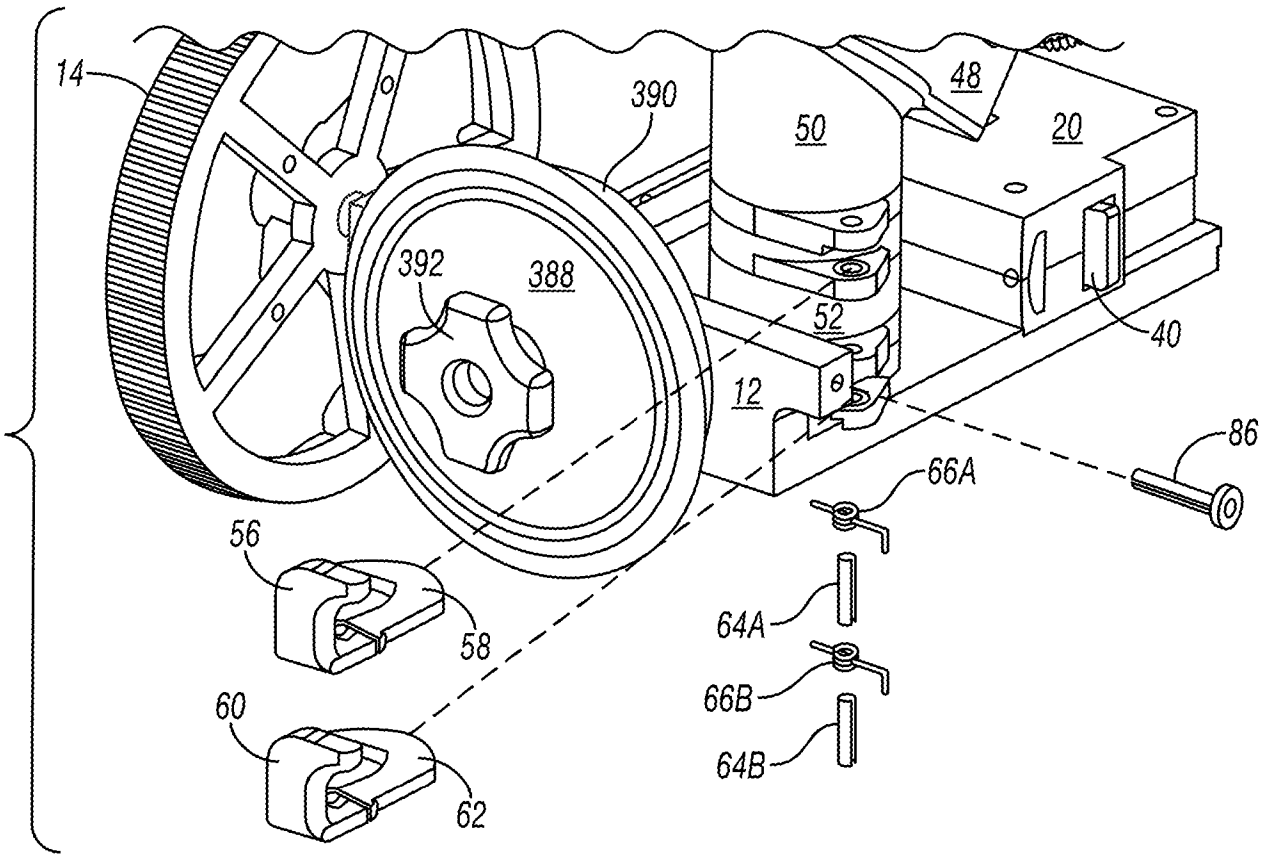
FIG. 7 is another partial perspective, exploded view of the system similar to FIG. 6.
Figure 8:
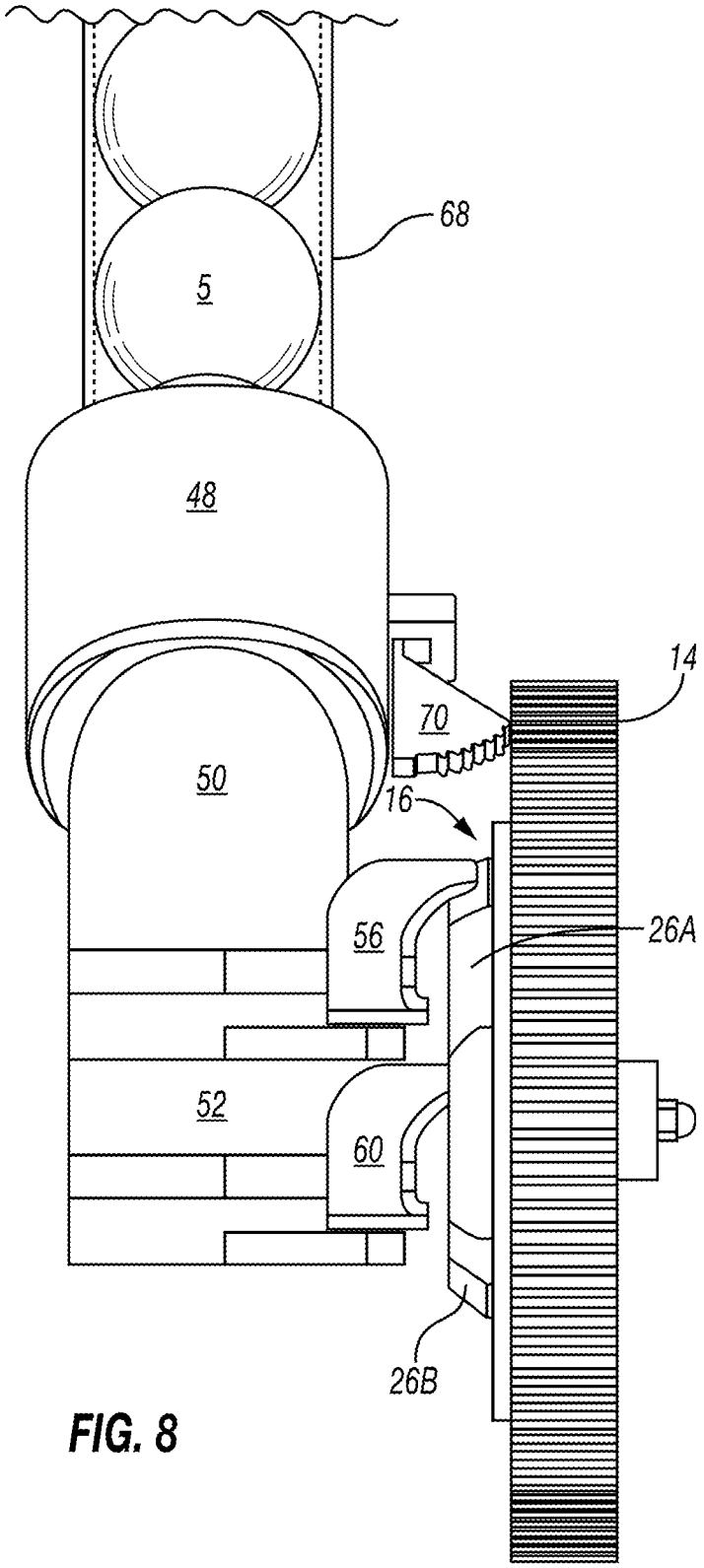
FIG. 8 is a partial, cutaway elevational view of parts of the system as in FIG. 1.
Figure 9:
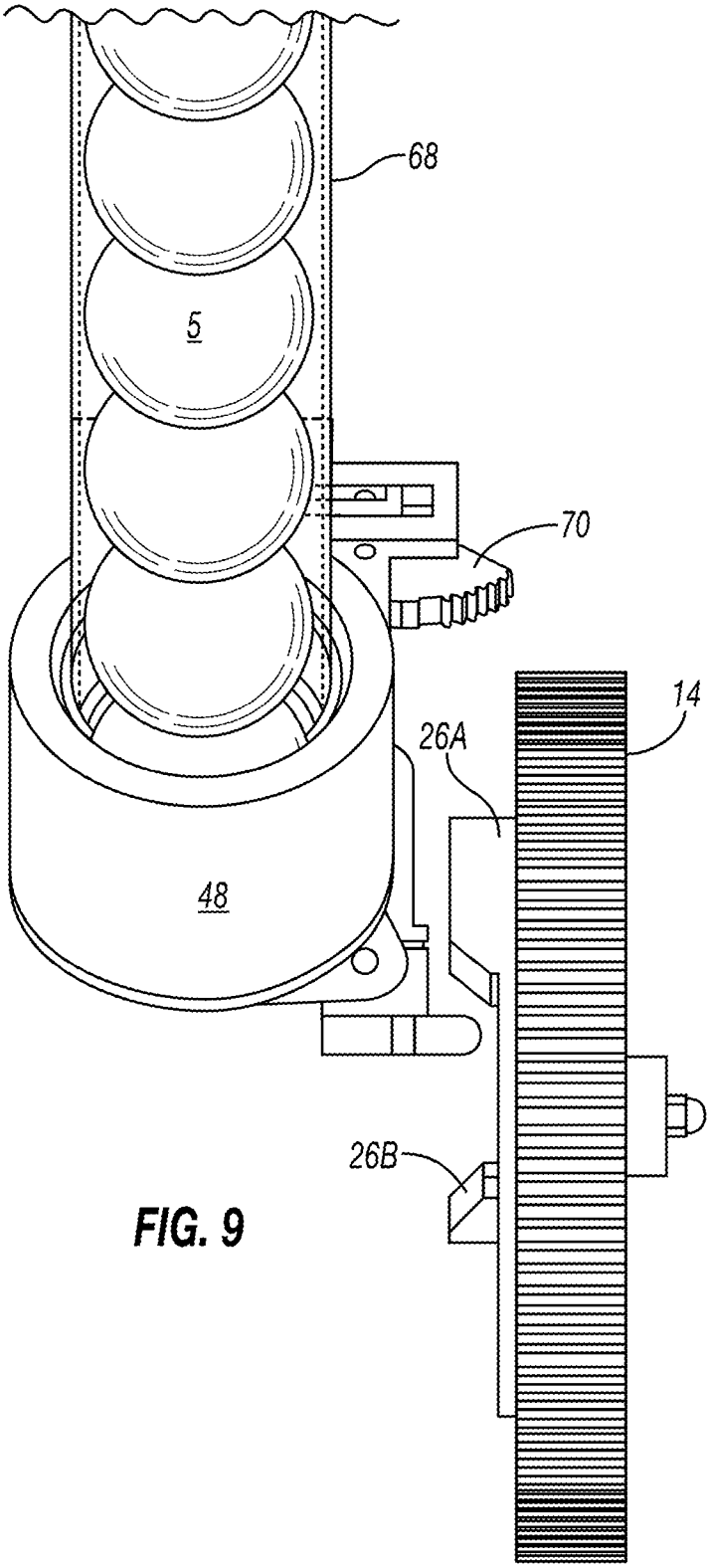
FIG. 9 is a partial, cutaway elevational view of parts of the system as in FIG. 8.

With reference now to FIGS. 7, 8, and 9, the wheels 14, the timing wheel 16, timing cams 26A and 26B and related components briefly introduced above are most clearly shown. More particularly, a user would place the tape clip 46 attached to the extended tape 42 (see FIG. 1) around the pin 394, which the user has positioned in the cup 3 or at another target location as described above. Next, the user pushes the golf practice system 10 around the desired practice hole 3. As the system 10 is being pushed, the base wheels 14 are rotated in a counter clockwise direction, which in turn rotates the device timing wheel 16 in a counter clockwise direction. As introduced above, the turning of the timing wheel 16 brings the timing wheel cam 26A into contact with the golf ball stop lever 56 as particularly shown in FIG. 8. Additional forward movement causes the timing wheel 16 to rotate further counter clockwise thereby pushing back the golf ball stop lever 56, which rotates around a base pin 64A as shown in FIG. 7. This rotation then moves the golf ball stop numb 58 away from the golf ball 5 in the tube 68, which allows the golf ball 5 to drop due to gravity. The golf ball release numb 62 prevents the golf ball 5 from dropping further. Notably, the golf ball stop lever 56 (and its golf ball stop numb 58) and the golf ball release lever 60 (and its golf ball release numb 62) will not be engaged open at the same time due to the timing wheel cams 26A and 26B being 180 degrees out of phase (compare FIGS. 8 and 9). As the system 10 continues to move forward, the golf ball stop lever 56 returns to its original position via base pin spring 66A when the timing wheel cams 26A or 26B have passed by in rotation. This position return prevents further golf ball drops past stop numb 58.

As the system 10 continues to move in a counter clockwise direction around the practice hole 3, the timing wheel 16 also continues to rotate the timing wheel cam 26B and eventually engages the release lever 62, which in turn retreats and rotates around base pin 64B and allows release lever numb 62 to move out of the way and allow the single golf ball 5 situated between the stop lever 56 and the stop lever 60 to drop through the unit hole 54 to the lawn, putting green, putting platform, or the like. As the system 10 continues to move forward, the release lever 56 is returned to its original position via the release spring 66B rotating around the base pin 64B and back to its original position whereby the timing wheel cam 26B is no longer engaged on the release lever 56. This action continues until the system 10 is no longer moved forward, or there is no longer a supply of golf balls 5 in the tube 68.

Figure 10:
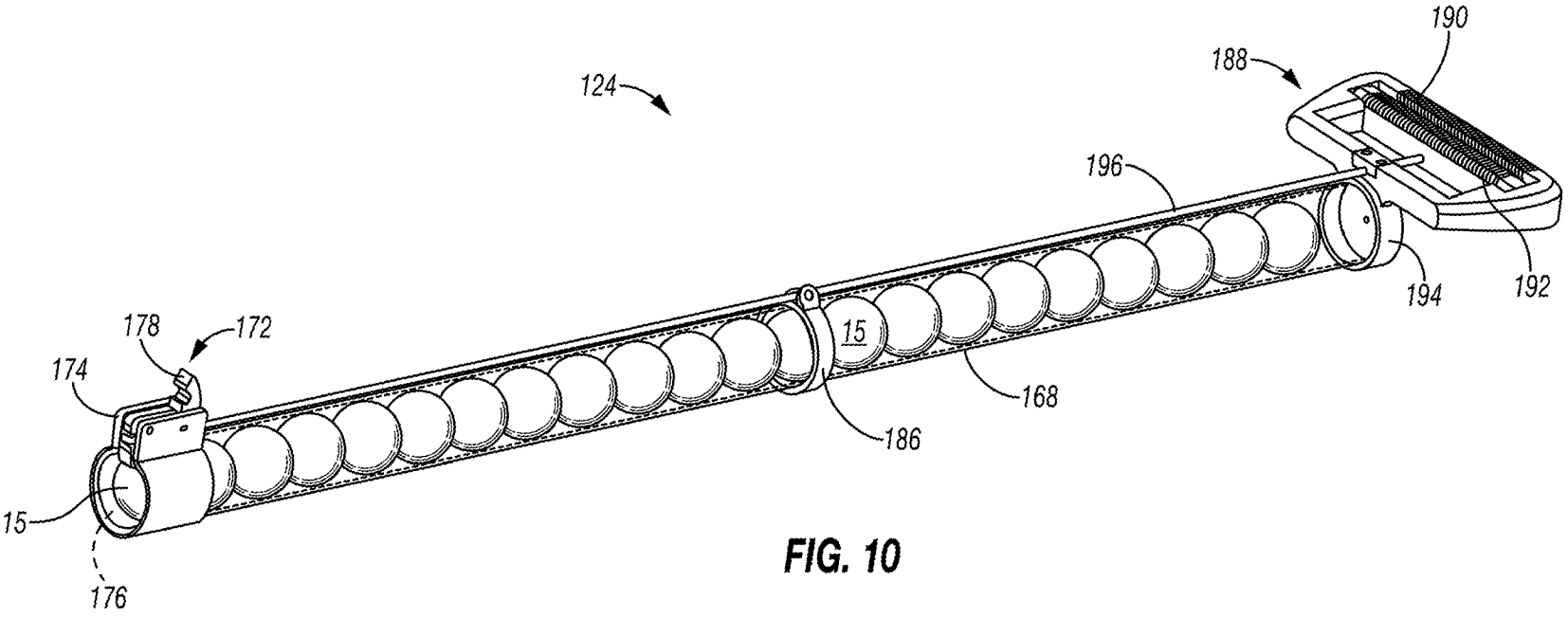
FIG. 10 is a perspective view of the component as in FIGS. 3 and 4.

FIG. 10 shows another embodiment of a device, broadly designated by element number 124, for retrieving, storing and dispensing golf balls for hitting, chipping and putting practice. The golf ball device 124 may include a hollow tube 168 with a locking and release mechanism 172. The mechanism 172 may include a sleeve 174 and a latch 178 to restrict golf balls 15 from leaving an end or opening 176 in the tube 168 until a user wants to distribute the balls 15, which can be filled from the opening 176 to a ball stop or top end 194. The user will operate the golf ball device 124 using a handle 188 that may include a top grip 190 and a bottom grip 192, which are movable relative to each other to operate a grip release rod 196 as explained below. Also shown, a support ring 186 may be provided to add structural support to the tube 168 and to help guide and maintain the grip release rod 196 during retraction and release stages.

Figure 11A:
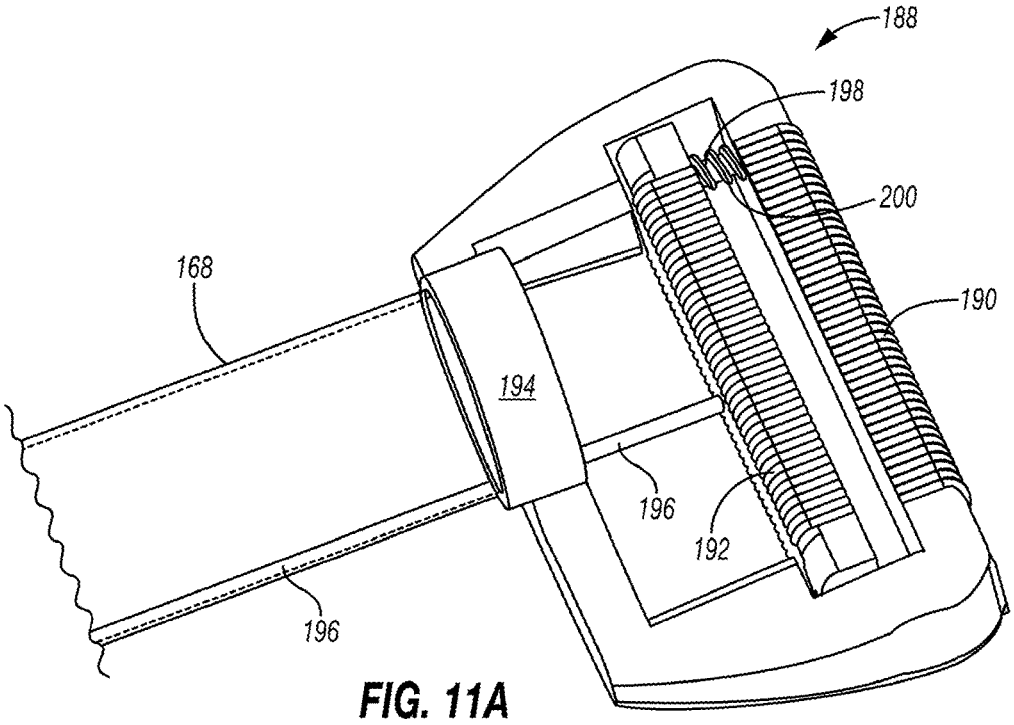
FIG. 11A is a partial perspective view of a portion of one side of the component as in FIG. 9.
Figure 11B:
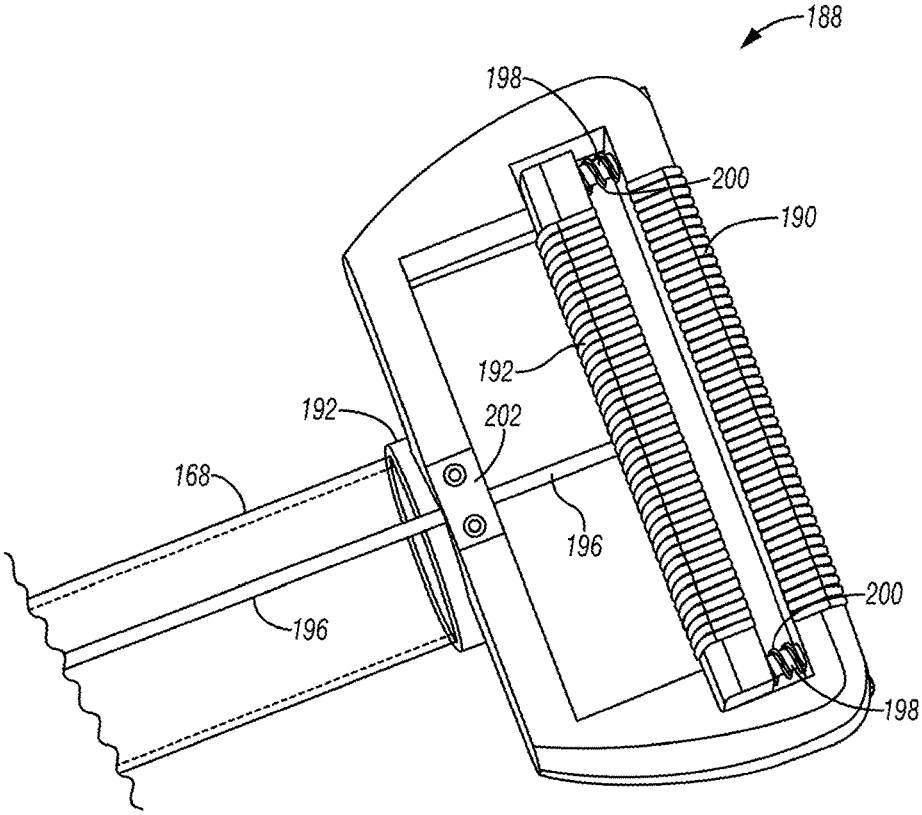
FIG. 11B is a partial perspective view of the portion of another side of the component as in FIG. 11A.
Figure 11C:
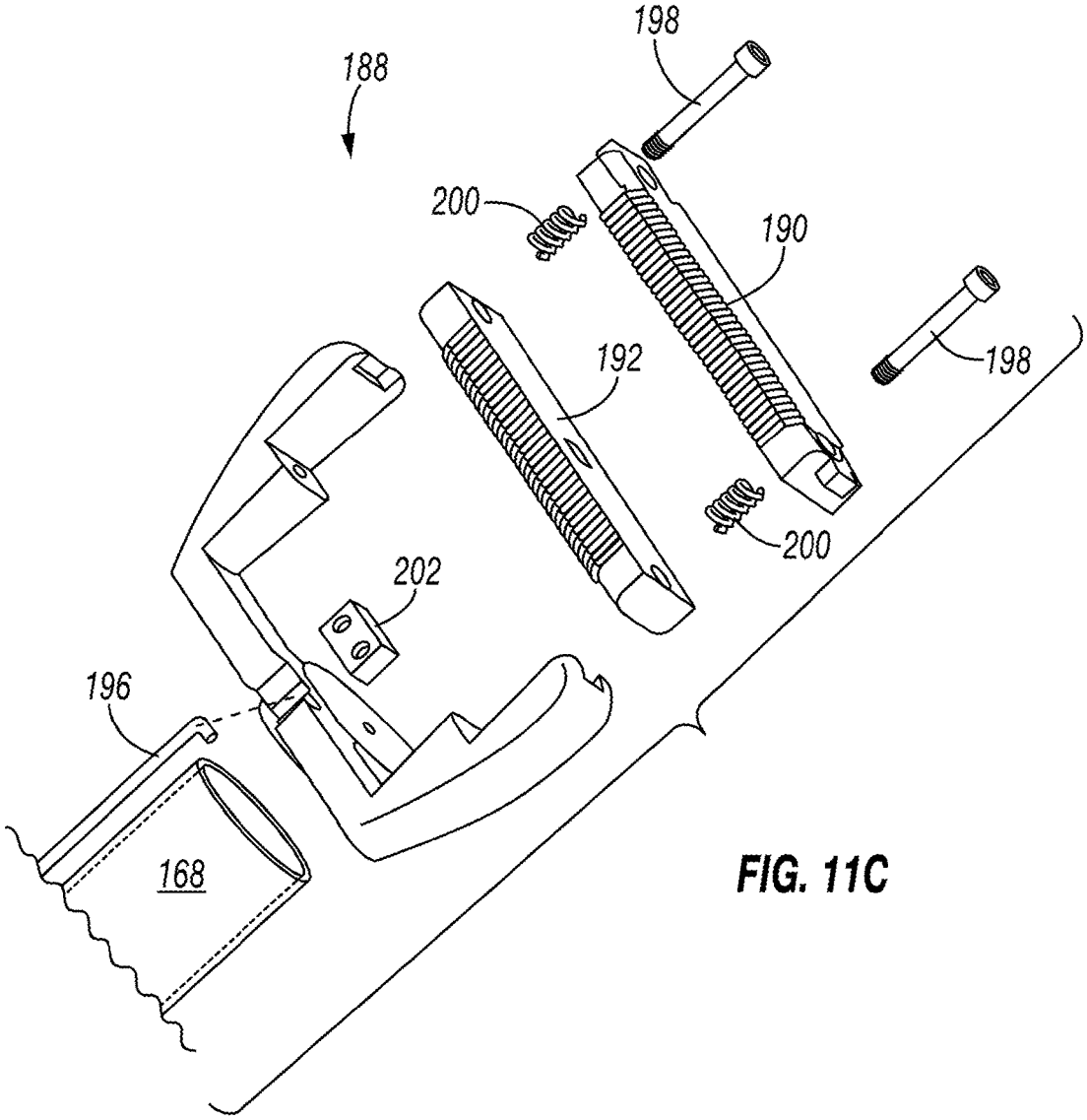
FIG. 11C is a partial, exploded, perspective view of the portion as in FIG. 11B.
Figure 12:
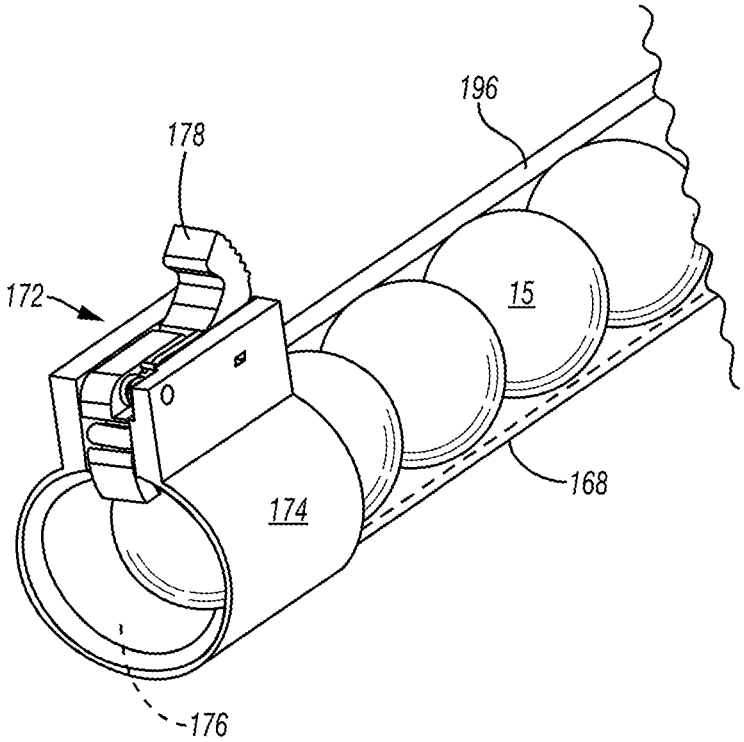
FIG. 12 is a perspective end view of another portion of the component as in FIG. 9.
Figure 13:
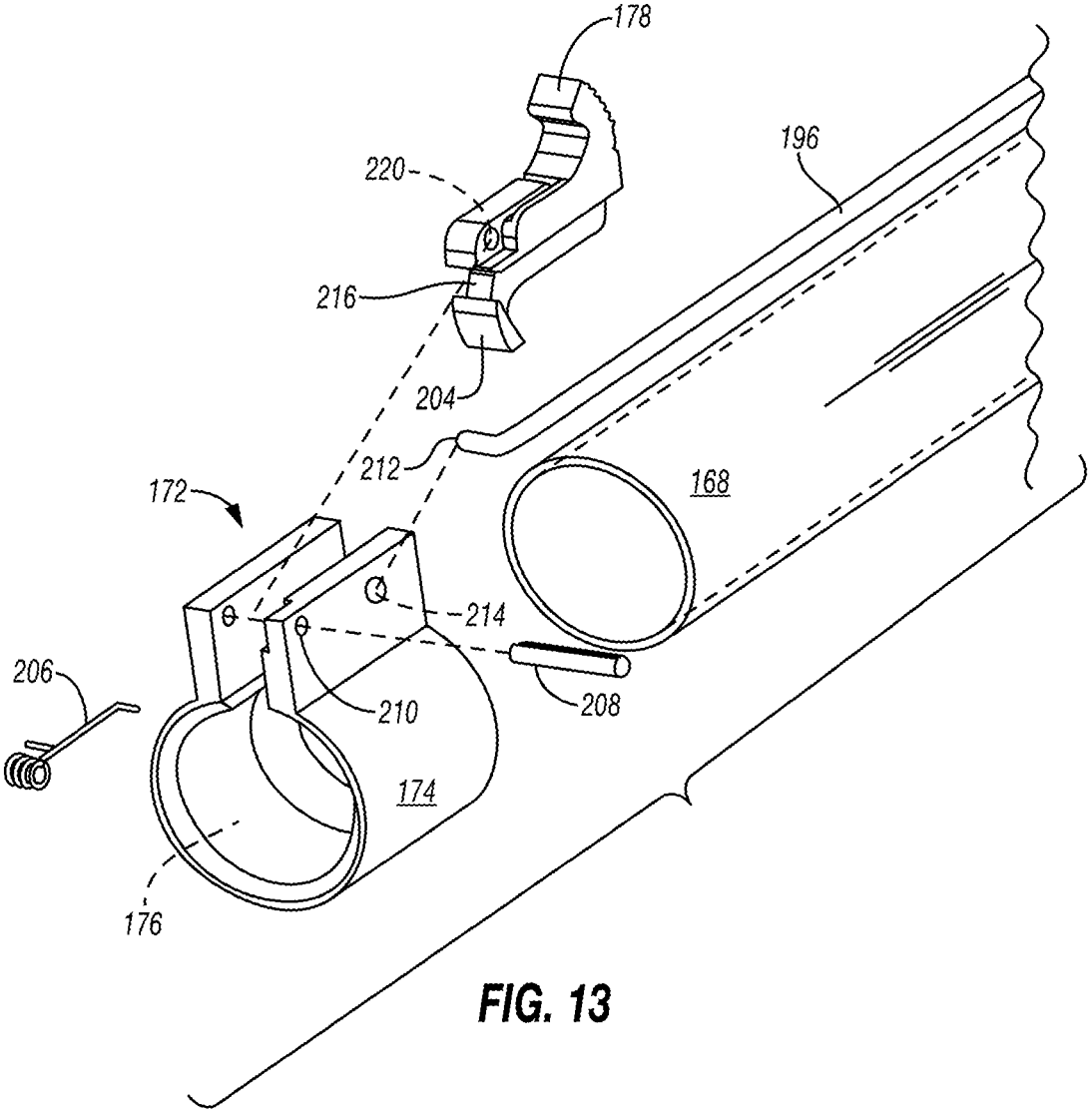
FIG. 13 is a perspective, exploded, end view of the portion of the component as in FIG. 12.
Figure 14:
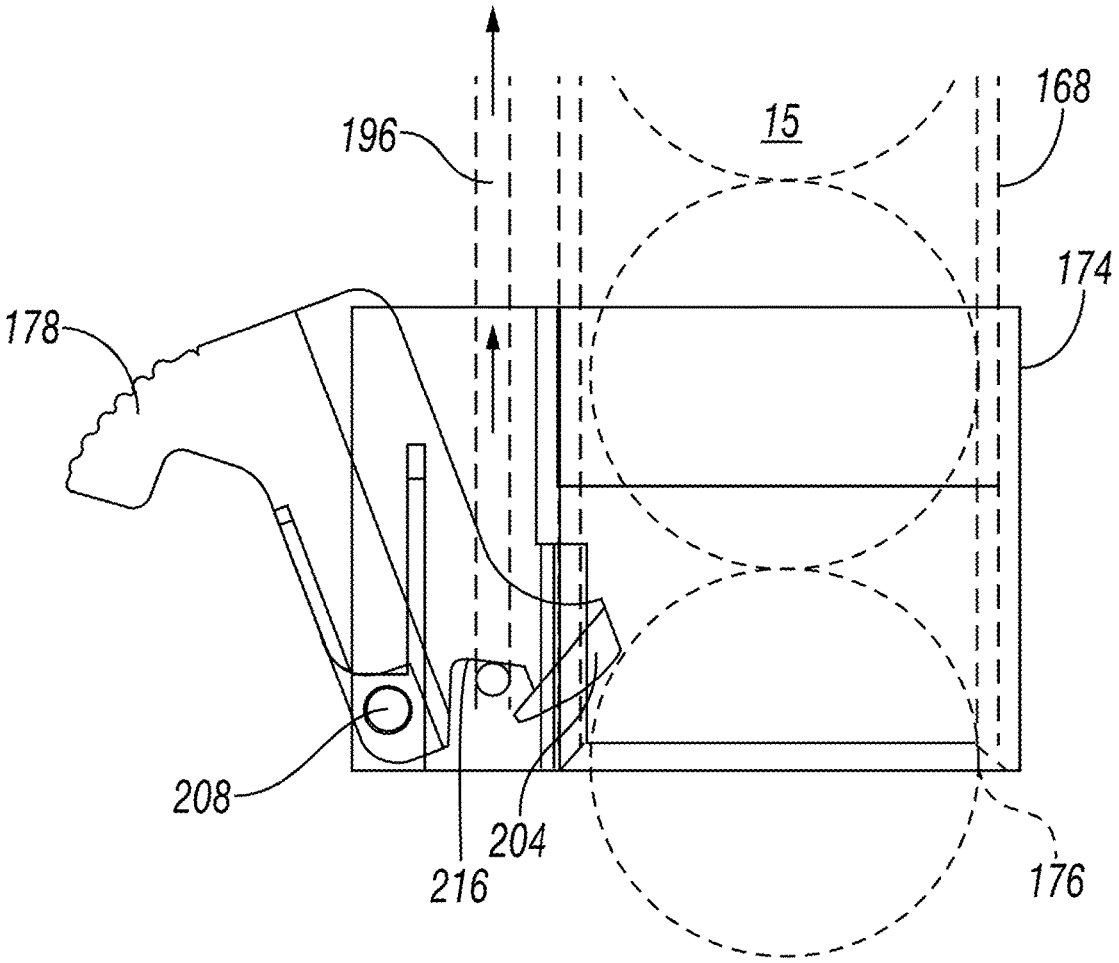
FIG. 14 is a perspective, exploded, end view of the portion of the component as in FIG. 12, particularly showing an interim operation.
Figure 15:
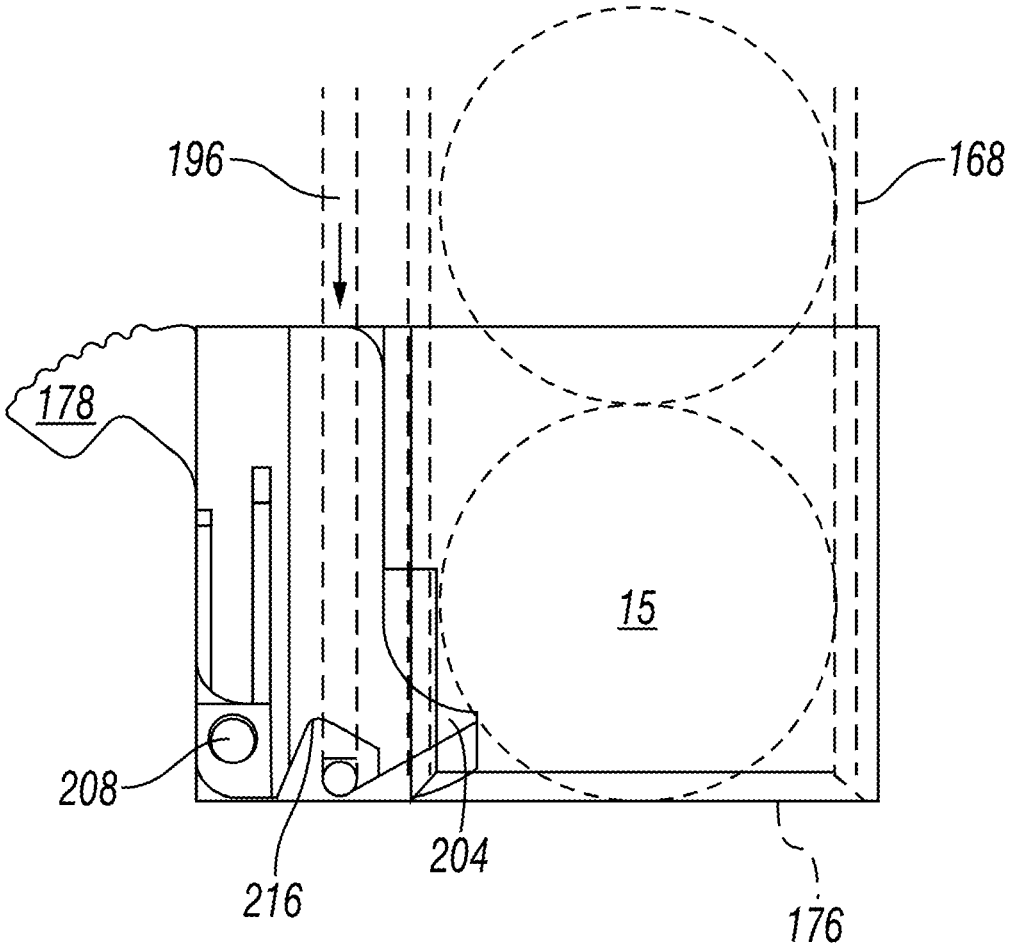
FIG. 15 is a partial, cutaway, elevational view of the portion of the component as in FIG. 13, particularly showing a completed operation.

FIGS. 11A, 11B, and 11C most clearly show the grip release rod 196, which is pulled toward the top grip 190 by compressing grip springs 200 along guide bolts 198. The guide bolts 198 are used to hold the bottom grip 192, the top grip 190, and the grip compression springs 200 in place. As particularly shown in FIG. 11C, the rod 196 is threaded or inserted through a portion of the handle 188 and secured with a guide lock 202 that allows piston movement of the rod 196 but prevents lateral movement or separation from the handle 188 along with the support ring 186 introduced in FIG. 10.

An exemplary method for releasing the golf balls 15 uses the device 124 independently. With reference to FIGS. 11A, 11B, 11C, 12, 13, 14, and 15, by moving the latching lever 178 outward, the ball block 204 is moved out of the way to allow the golf balls 5 to drop to the ground and out of the tube 168 through opening 176. Another method is accomplished by squeezing the bottom grip 192. This pulls the release rod 196 toward the top grip 190 and (see FIG. 14), which compresses the grip springs 200 along the guide bolts 198. As the release rod 196 is pulled upward, a crook 216 of the latching lever 178 is pulled upward by the rod 196, and the golf ball locking/release lever 178 is pushed away from the tube 168. This causes the ball block 204 to move out of the way allowing the golf balls 15 to drop to the ground and out of the storage tube 168. To store the balls 15 in the golf ball device 124, the tube 168 is lowered over a golf ball 15 until the ball 15 is locked in place by the ball block 204.

Figure 16A:
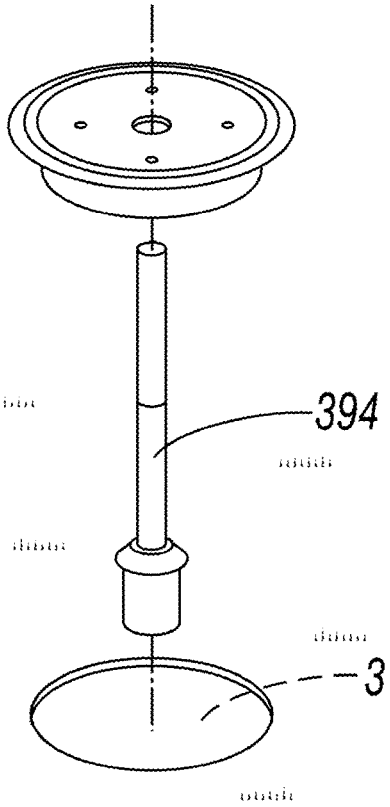
FIG. 16A is a perspective, exploded view of a temporary pin apparatus detached from the system in FIG. 1.
Figure 16B:
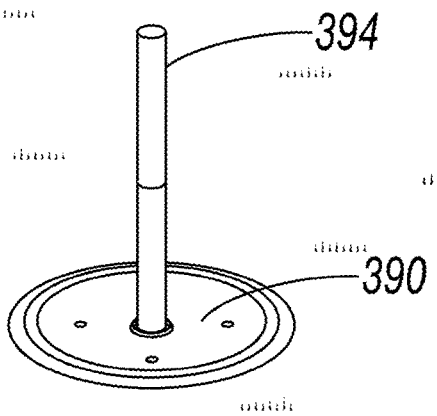
FIG. 16B is a perspective view of the temporary pin apparatus in operation as in FIG. 16A.

Referring now to FIGS. 16A and 16B, the temporary pin 394 is detached from the system 10 introduced above and placed into the practice golf hole 3 with the temporary golf hole cover 390 over the top. More particularly, the pin 394 extends through an aperture in the cover 390 in order to attach the tape clip 46 as shown in FIG. 1 to be placed around the temporary pin 394. This allows the system 10 to be moved around the hole 3 without damaging it or pulling the pin 394 out of the hole 3.

Figure 17A:
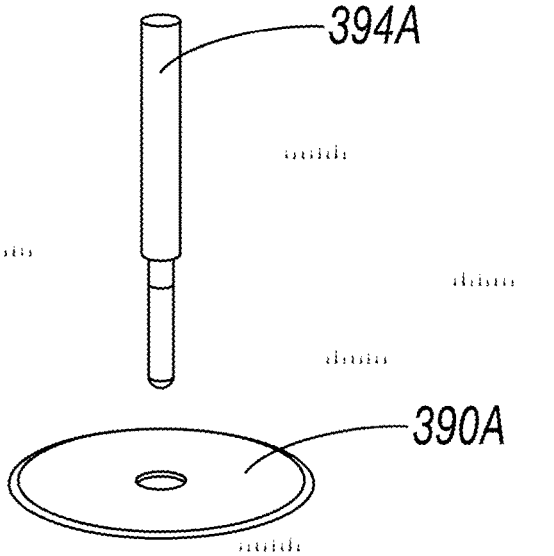
FIG. 17A is a perspective, exploded view of a temporary pin top detached from the system in FIG. 1.
Figure 17B:
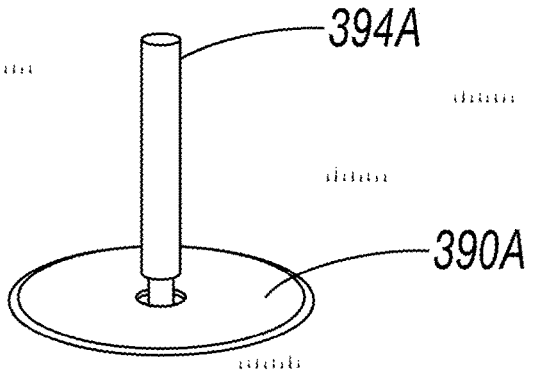
FIG. 17B is a perspective view of the temporary pin top in operation as in FIG. 17A.

FIGS. 17A and 17B show a separated temporary pin 394A and its top half placed through a temporary golf hole 390A, which can be placed anywhere on a putting green. This allows the tape clip 46 as shown in FIG. 1 to be placed around the temporary pin top half 394A. This allows the system 10 to be moved around the putting surface without damaging it or pulling the pin 394A out while the user creates the practice condition he is looking for without using one the preexisting practice golf hole on the practice green.

Figure 18:
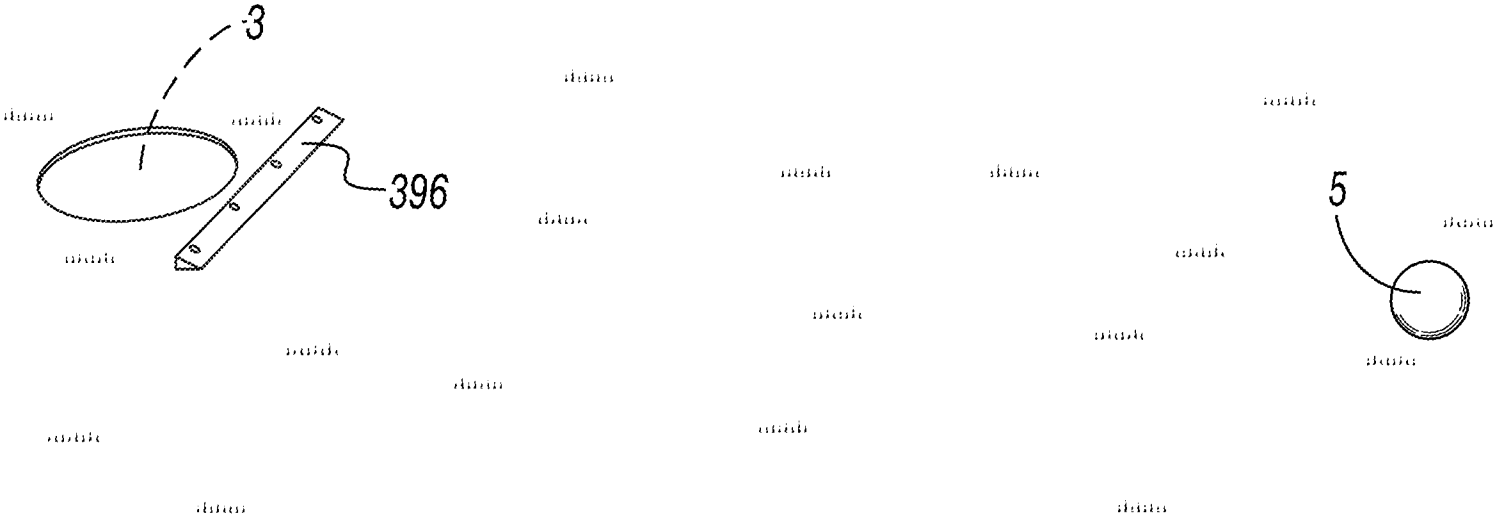
FIG. 18 is a perspective view of a speed ramp detached from the system in FIG. 1.

FIG. 18 shows the speed ramp 396 introduced in FIGS. 5 and 6. Here, the speed ramp 396 has been detached from the base 12 and pressed into the green surface ½ to 1 inch in front of the golf hole 3 using the spikes 396A introduced above. The speed ramp 396 helps the golfer by forcing the golfer to hit the golf ball 5 sufficiently firmly on chips and putts to get the ball 5 into the hole 3. Without enough speed imparted on the ball 5 to get over the angled ramp 396, the ball 5 will roll back toward the golfer and the putt will be missed. The same speed ramp 396 when placed approximately 12 to 18 inches behind the hole 3 will force the golfer to avoid hitting the ball 5 too hard. In other words, if the putted or chipped golf ball 5 makes it over the speed ramp 396 when placed behind the hole 3, the golf ball 5 was hit too hard.

EXEMPLARY EMBODIMENTS

Embodiment 1

A golf ball positioning dispenser for putting practice and chipping practice, comprising a base having an opening therethrough for dispensing a plurality of golf balls; at least two base wheels rotatably connected to the base; a ball drop mechanism attached to the base, the ball drop mechanism being configured for dispensing the golf balls; a timing wheel attached to one of the base wheels and in communication with the ball drop mechanism to dispense a golf ball at a preset distance; and a tape measure mechanism connected to the base to determine a radial distance from a target.

Embodiment 2

The dispenser of embodiment 1, wherein the ball drop mechanism includes a ball release lever and a ball retention lever, the levers being pivotally attached to the base and configured for alternating cycles to dispense golf balls.

Embodiment 3

The dispenser of embodiment 2, further comprising ball numbs disposed at respective ends of each lever wherein the timing wheel engages the levers by contacting their respective numbs.

Embodiment 4

The dispenser of embodiment 3, wherein the timing wheel includes a plurality of cams for engaging the respective numbs.

Embodiment 5

The dispenser of embodiment 4, wherein the cams are disposed at a predetermined angular distance from each other on the timing wheel.

Embodiment 6

The dispenser of any of the foregoing embodiments, further comprising a detachable golf ball holder connectable to the ball drop mechanism.

Embodiment 7

The dispenser of embodiment 6, wherein the holder is made of a transparent material and is cylindrical in shape.

Embodiment 8

The dispenser of embodiment 6 or 7, wherein the holder includes a handle configured for compression, whereby, when the holder is detached from the dispenser, the compressed handle controls release of the golf balls.

Embodiment 9

The dispenser of any of the foregoing embodiments, further comprising a stabilizing wheel disposed apart from the base wheels.

Embodiment 10

The dispenser of any of the foregoing embodiments, further comprising a tape marked for pre-defined distances from a practice target, and wherein a user can adjust and lock the tape to a desired radius of travel around the target.

Embodiment 11

The dispenser of any of the foregoing embodiments, further comprising a practice pin for placement in a practice golf cup or to form a practice target.

Embodiment 12

The dispenser of any of the foregoing embodiments, further comprising a speed ramp for placement near a target to aid in putting speed practice.

Embodiment 13

A golf ball positioning dispenser for putting and chipping practice, comprising a base having an opening therethrough for dispensing a plurality of golf balls; a detachable golf ball holder for holding the golf balls; at least two base wheels rotatably connected to the base; a ball drop mechanism attached to the base, the ball drop mechanism being connectable with the golf ball holder for receiving and dispensing the golf balls; a timing wheel attached to one of the base wheels and in communication with the ball drop mechanism to dispense a golf ball at a preset distance; and a tape measure mechanism connected to the base to determine a radial distance from a target.

Embodiment 14

The dispenser of embodiment 13, wherein the ball drop mechanism includes a ball release lever and a ball retention lever, the levers being pivotally attached to the base through an axial pin to control the ball release lever and the ball retention lever to provide ball dispensing as the base wheels move.

Embodiment 15

The dispenser of embodiment 14, wherein the timing wheel biases and alternately enables the ball release lever and the ball retention lever.

Embodiment 16

The dispenser of embodiment 15, wherein the bias applied to each lever is provided by a spring extending to contact the levers, wherein, in a relaxed state, the ball release lever and the ball retention lever hold the balls for dispensing.

Embodiment 17

The dispenser of embodiments 15 or 16, further comprising a ball numb attached to respective ends of the biased levers and a timing wheel cam, wherein the timing wheel cam is engageable with the biased lever by contacting the ball numb.

Embodiment 18

The dispenser as in embodiments 13-17, further comprising a plurality of timing wheel cams, the timing wheel cams being in concentric alignment with an outer circumference of at least one of the base wheels.

Embodiment 19

The dispenser as in embodiments 13-18, further including a method of using the golf ball positioning dispenser for putting and chipping practice, comprising moving a latching lever of the detachable golf ball holder away from the detachable golf ball holder.

Embodiment 20

The dispenser as in embodiments 13-19, further including a method of using the golf ball positioning dispenser for putting and chipping practice as in claim 13, comprising squeezing together a top grip top and a bottom grip of the detachable golf ball holder thereby pulling a release rod and moving a latching lever away from the detachable golf ball holder.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

That which is claimed is:

1. A golf ball positioning dispenser for putting and chipping practice, comprising:

a base having an opening therethrough for dispensing a plurality of golf balls;

at least two base wheels rotatably connected to the base;

a ball drop mechanism attached to the base, the ball drop mechanism being configured for dispensing the golf balls;

a timing wheel attached to one of the base wheels and in communication with the ball drop mechanism to dispense a golf ball at a preset distance; and a tape measure mechanism connected to the base to determine a radial distance from a target.

2. The dispenser as in claim 1, further comprising a stabilizing wheel disposed apart from the base wheels.

3. The dispenser as in claim 1, further comprising a tape marked for pre-defined distances from a practice target, and wherein a user can adjust and lock the tape to a desired radius of travel around the target.

4. The dispenser as in claim 1, further comprising a practice pin for placement in a practice golf cup or to form a practice target.

5. The dispenser as in claim 1, further comprising a speed ramp for placement near a target to aid in putting speed practice.

6. The dispenser as in claim 1, wherein the ball drop mechanism includes a ball release lever and a ball retention lever, the levers being pivotally attached to the base and configured for alternating cycles to dispense golf balls.

7. The dispenser as in claim 6, further comprising ball numbs disposed at respective ends of each lever wherein the timing wheel engages the levers by contacting their respective numbs.

8. The dispenser as in claim 7, wherein the timing wheel includes a plurality of cams for engaging the respective numbs.

9. The dispenser as in claim 8, wherein the cams are disposed at a predetermined angular distance from each other on the timing wheel.

10. The dispenser as in claim 1, further comprising a detachable golf ball holder connectable to the ball drop mechanism.

11. The dispenser as in claim 10, wherein the holder is made of a transparent material and is cylindrical in shape.

12. The dispenser as in claim 10, wherein the holder includes a handle configured for compression, whereby, when the holder is detached from the dispenser, the compressed handle controls release of the golf balls.

13. A golf ball positioning dispenser for putting and chipping practice, comprising:

a base having an opening therethrough for dispensing a plurality of golf balls;

a detachable golf ball holder for holding the golf balls;

at least two base wheels rotatably connected to the base;

a ball drop mechanism attached to the base, the ball drop mechanism being connectable with the golf ball holder for receiving and dispensing the golf balls;

a timing wheel attached to one of the base wheels and in communication with the ball drop mechanism to dispense a golf ball at a preset distance; and a tape measure mechanism connected to the base to determine a radial distance from a target.

14. A method of using the golf ball positioning dispenser for putting and chipping practice as in claim 13, comprising moving a latching lever of the detachable golf ball holder away from the detachable golf ball holder.

15. A method of using the golf ball positioning dispenser for putting and chipping practice as in claim 13, comprising squeezing together a top grip and a bottom grip of the detachable golf ball holder thereby pulling a release rod and moving a latching lever away from the detachable golf ball holder.

16. The dispenser as in claim 13, wherein the ball drop mechanism includes a ball release lever and a ball retention lever, the levers being pivotally attached to the base through an axial pin to control the ball release lever and the ball retention lever to provide ball dispensing as the base wheels move.

17. The dispenser as in claim 16, wherein the timing wheel biases and alternately enables the ball release lever and the ball retention lever.

18. The dispenser as in claim 17, wherein the bias applied to each lever is provided by a spring extending to contact the levers, wherein, in a relaxed state, the ball release lever and the ball retention lever hold the balls for dispensing.

19. The dispenser as in claim 18, further comprising a ball numb attached to respective ends of the biased levers and a timing wheel cam, wherein the timing wheel cam is engageable with the biased lever by contacting the ball numb.

20. The dispenser as in claim 19, further comprising a plurality of timing wheel cams, the timing wheel cams being in concentric alignment with an outer circumference of at least one of the base wheels.

* * * * *